US005431490A

United States Patent [19]

Edwards

[11] Patent Number: 5,431,490

[45] Date of Patent: Jul. 11, 1995

[54] REFRIGERATOR/FREEZER DOOR ANTI-CONVECTION CURRENT CURTAIN

[76] Inventor: Brian E. Edwards, 1310 Rudy, Mattoon, Ill. 61938

[21] Appl. No.: 49,445

[22] Filed: Apr. 20, 1993

[51] Int. Cl.[6] ..... A47F 3/04

[52] U.S. Cl. ..... 312/116; 312/405; 62/248; 160/184

[58] Field of Search ..... 312/116, 401, 405, 405.1; 62/248, 256, 265; 160/184, 332

[56] References Cited

U.S. PATENT DOCUMENTS 2,041,258 5/1936 Mitchell ..... 160/184 X
3,186,185 6/1965 Bently et al. .
4,109,484 8/1978 Cunningham .
4,288,992 9/1981 Eliason ..... 62/265 X
4,313,485 2/1982 Gidge et al. ..... 160/332 X
4,392,360 7/1983 Gidge et al. .
4,400,046 8/1983 Karashima .
4,429,548 2/1984 Layne .
4,539,819 9/1985 Alba et al. ..... 62/265 X

*Primary Examiner*—Brian K. Green
*Attorney, Agent, or Firm*—Jacobson, Price, Holman & Stern

[57] ABSTRACT

A vertical curtain is provided with vertical slits therein spaced thereacross, opening downwardly through the lower margin of the curtain and terminating upwardly a spaced distance below the upper margin of the curtain. The upper margin of the curtain is mounted on the margin of a refrigerated cabinet wall having an access opening formed therein extending across the upper portion of the opening such that the curtain will fall by gravity downwardly across the opening as a thermal and convection current barrier when the door for the access opening is opened.

4 Claims, 2 Drawing Sheets

REFRIGERATOR/FREEZER DOOR ANTI-CONVECTION CURRENT CURTAIN

BACKGROUND OF THE INVENTION

FIELD OF THE INVENTION

This invention relates to a flexible, vertical and slotted transparent curtain secured along its non-slotted upper margin to the upper margin of a door opening of a cabinet having cooling means associated therewith and a door swingably supported from the cabinet for opening and closing the opening, the curtain serving to substantially reduce convection currents which would allow cooler air to fall from within the cabinet and be replaced by warmer ambient air when the door of the cabinet is opened.

DESCRIPTION OF RELATED ART

Various different forms of curtains and other means for providing a thermal protective barrier for open refrigerator cabinets heretofore have been provided. Examples of such previously known devices are disclosed in U.S. Pat. Nos. 3,186,185, 4,109,484, 4,392,360, 4,400,046 and 4,429,548. However, these previously know devices do not include the specific structural features of the instant invention and incorporate the combination of those features in conjunction with a conventional refrigerator and/or freezer in the manner disclosed herein.

SUMMARY OF THE INVENTION

A slotted flexible and transparent thermal barrier curtain is provided for an opening in a refrigerator or freezer normally closed by a horizontally swingable door equipped with a peripheral seal for sealed engagement with the face of the refrigerator or freezer cabinet extending about the opening closable by the door.

The curtain has been specifically designed such that the resilient door seal will cross interface areas of the cabinet and curtain only at two extreme opposite side portions of the upper margin of the door opening to thus limit any possible areas of air leakage between the exterior and interior of the refrigerator or freezer and with those two areas disposed at substantially the same elevation to thereby eliminate all tendencies of convection currents to exist between the interior and exterior of the cabinet.

The main object of this invention is to provide a thermal curtain which will greatly reduce the entrance of warm air into an upright refrigerator or freezer when the door thereof is opened and yet allow ready access to any items within the refrigerator or freezer.

Another object of this invention is to provide a thermal barrier construction which may be readily marketed in a few different sizes and with each size being readily modified by the ultimate user for use with a particular refrigerator or freezer cabinet opening.

A further object of this invention is to provide a thermal barrier in accordance with the preceding objects and which may be readily installed by the ultimate purchaser.

A final object of this invention to be specifically enumerated herein is to provide a thermal barrier for use in conjunction with upright refrigerators and freezers and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
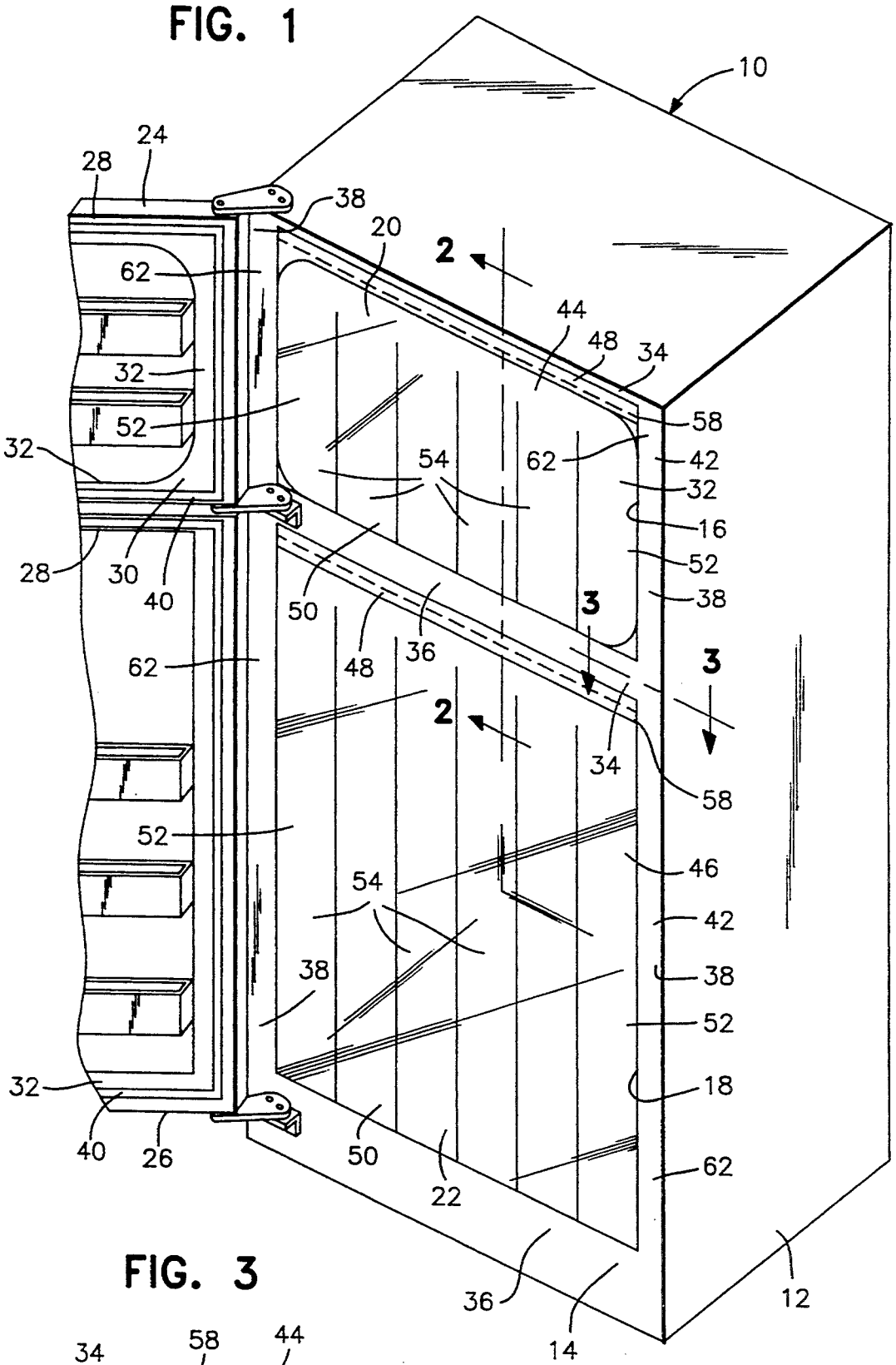
FIG. 1 is a perspective view of a typical upright refrigerator/freezer combination with the upper and lower doors of the freezer and refrigerator compartments thereof being partially illustrated in open positions.

Referring now more specifically to FIG. 1 the numeral 10 generally designates a typical refrigerator-freezer including a cabinet 12 having a front wall 14 in which a pair of upper and lower openings 16 and 18 are formed opening into the freezer and refrigerator compartments 20 and 22, respectively.

The cabinet 12 includes upper and lower doors 24 and 26 hingedly supported therefrom for opening and closing the openings 16 and 18 and each of the doors includes an inner surface including upper, lower and opposite side portions 28, 30 and 32 which closely oppose the corresponding upper, lower and opposite side edges 34, 36 and 38 of the front wall 14 which extend about the openings 16 and 18. The upper, lower and opposite side portions 28, 30 and 32 each, together, include a continuous seal bead 40 extending thereabout and which is compressively engaged between the portions 28, 30 and 32 and corresponding portions of a seal zone 42 defined by each set of edges 34, 36 and 38.

Figure 3:
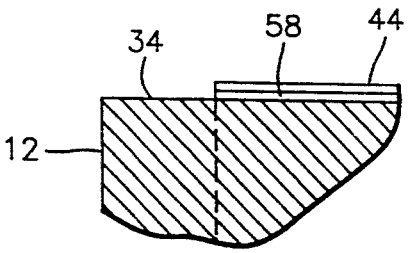
FIG. 3 is an enlarged fragmentary horizontal sectional view taken substantially upon the plane indicated by the section line 3—3 of FIG. 1.
Figure 3A:
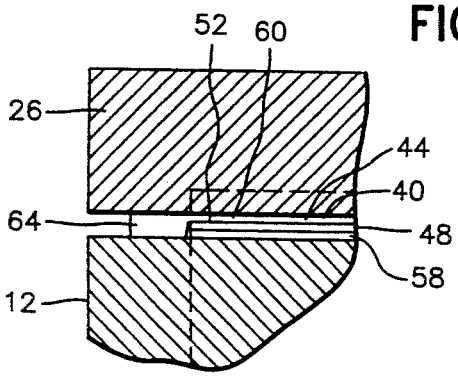
FIG. 3A is a fragmentary horizontal sectional view similar to FIG. 3 but with the associated freezer compartment door in the closed position.

Upper and lower anti-convection curtain assemblies 44 and 46 are operatively associated with the openings 16 and 18 and each curtain assembly comprises an upstanding panel of flexible, transparent material including upper, lower and opposite side margins 48, 50 and 52 as well as vertical slits 54 formed therein opening through the lower margins 50 and terminating upwardly a spaced distance below the upper margins 48. The upper margins 48 are secured to the upper portions of the zones 42 through the utilization of double sided adhesive tape 58 along those portions of the upper edges 34 opposed by the upper portions 60 of the seal beads 40. However, the widths of the curtain assemblies 44 and 46 is at least substantially the width of the openings 16 and 18, but less than the space in between the opposite side portions 62 of the seal zones 42. Therefore, as shown in FIG. 3A, the upper portions 60 of the seal beads 40 pass over the opposite margins 52 of the curtain assemblies 44 and 46 immediately before each end of each upper portion 60 joins with the corresponding side portion 64 of the associated seal 40. Therefore, each seal 40 crosses only two edges of the corresponding curtain assembly 44, 46 at the extreme upper corners thereof to thereby greatly reduce the changes of air leakage between the interior of the cabinet 12 and the exterior thereof when the doors 28 and 26 are closed. Further, any such areas subject to possible leakage are located at the extreme upper corners of the corresponding compartments and, therefore, do not tend to set up any convection currents when the doors 24 and 26 are closed.

Figure 2A:
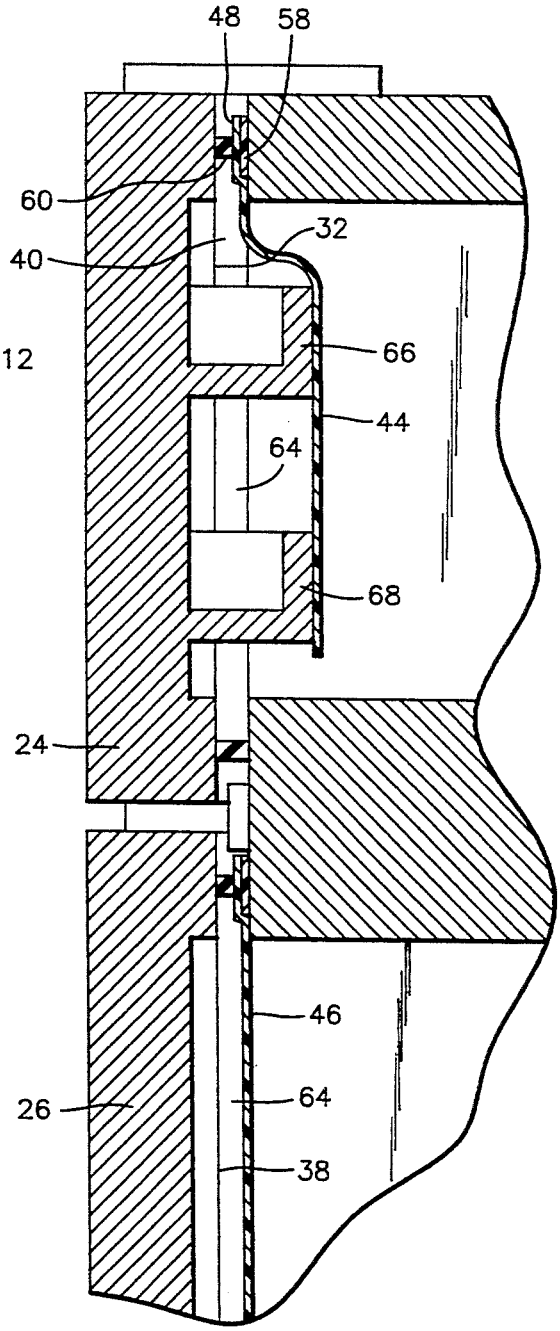
FIG. 2A is an enlarged vertical sectional view similar to FIG. 2 but with the freezer compartment and refrigerator compartment doors illustrated in closed positions.
Figure 2:
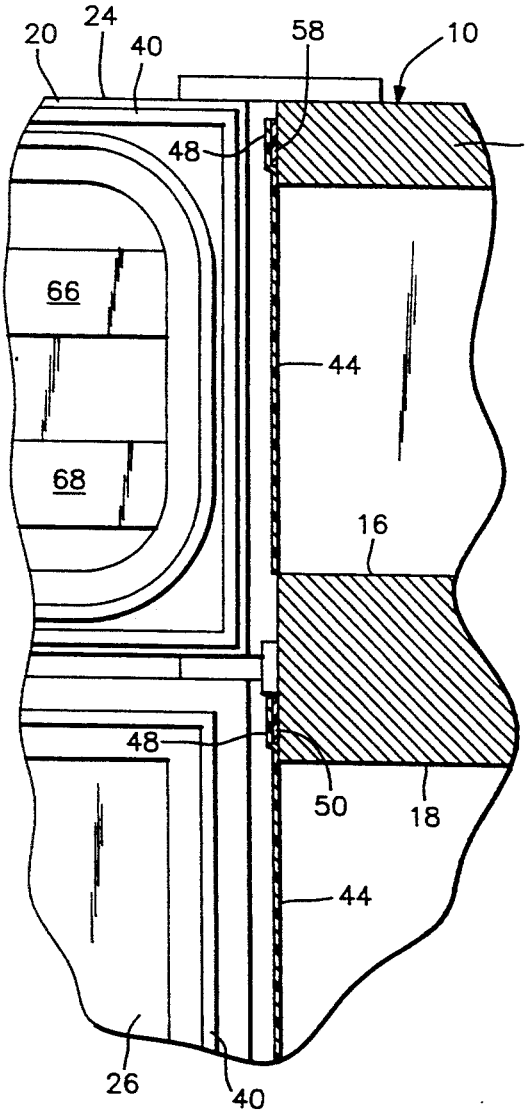
FIG. 2 is a fragmentary enlarged vertical sectional view taken substantially upon the plane indicated by the section line 2—2 of FIG. 1.

As may be seen from FIG. 2A, the door 24 includes a pair of vertically spaced inner shelves 66 and 68 which inwardly deflect the upper curtain assembly 44 when the door 24 is in the closed position. In addition, the lower door 26 also may include similar inwardly projecting shelves which would inwardly deflect the lower curtain assembly 46.

When either door 24 or 26 is opened, the corresponding curtain assembly substantially fully closes the corresponding opening as a thermal barrier therefore. The curtain assemblies are transparent and, accordingly, the location of a desired article within one of the compartments may be determined before reaching a hand inwardly through one of the slits 54 and withdrawing the desired article. Therefore, the intrusion of warm air into the top of the corresponding compartment coupled with the discharge of cool air from the lower portion of the corresponding compartment is greatly reduced when one of the doors is opened for only a short time to retrieve an article from the corresponding compartment.

Inasmuch as the seal zones 42 which oppose the seals 40 are usually disposed midway between the sides of the openings 16 and 18 and the corresponding outer side walls of the cabinet 12, the widths of the curtain assemblies 44 may be slightly greater than the openings 16 and 18, but less than the width of the zones 42. This will insure proper operation of the curtain assemblies 44. Furthermore, since the seal beads or strips 40 cross only the upper extremities of the opposite side margins 52 of the curtain assemblies 44, 46, the possibility of air leakage when the doors 24 and 26 are closed is greatly reduced.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalence may be resorted to, fall within the scope of the invention.

What is claimed as new is as follows:

1. A cabinet having an interior and cooling means associated therewith for cooling said interior to a temperature below ambient temperature and wherein said cabinet includes at least one generally vertical side having at least one access opening formed therein opening into said interior and defining substantially coplanar upper, lower and opposite side edges extending about said opening, said cabinet including a closure door swingably mounted from said cabinet for opening and closing said access opening, said door including an inner surface having upper, lower and opposite side portions closely opposing the corresponding upper, opposite side and lower edges of said one general vertical side of said cabinet disposed about said opening when said door is closed and being equipped with at least a substantially continuous seal bead compressively engaged between said portions and corresponding edges defining a seal zone extending about said opening having upper, lower and opposite side portions extending along said upper, lower and opposite side edges of said inner surface, an anti-convection curtain assembly including an upstanding flexible panel having upper, lower and opposite side margins, said panel including vertical slits therein terminating upwardly a Spaced distance below said upper margin and opening downwardly through said lower margin said upper margin being secured to said upper edge above said upper portion of said zone and with the upper ends of said slits terminating upwardly below said upper portion of said zone, said curtain assembly having a vertical extent such that, when said door is open, said lower margin is disposed above the lower portion of said seal zone, said opposite side margins of said curtain assembly being spaced inwardly of said opposite side portions of said seal zone, said lower margin and said opposite side margins of said curtain assembly, below said upper margin thereof, being free of stationary connection with said cabinet.

2. The combination of claim 1 wherein said lower margin extends downward at least to said lower edge when said door is opened.

3. The combination of claim 1 wherein said panel is transparent.

4. The combination of claim 1 wherein said door includes shelf structure projecting inwardly therefrom and inwardly of said curtain assembly below and above said upper and lower edges, respectively, when said door is closed.

* * * * *